US005295310A

United States Patent [19]

Eriksson

[11] Patent Number: 5,295,310

[45] Date of Patent: Mar. 22, 1994

[54] METHOD FOR DRYING A PARTICULATE MATERIAL

[75] Inventor: Lennart Eriksson, Växjö, Sweden

[73] Assignee: ABB Fläkt AB, Nacka, Sweden

[21] Appl. No.: 50,339

[22] PCT Filed: Nov. 14, 1991

[86] PCT No.: PCT/SE91/00774

§ 371 Date: Nov. 20, 1990

§ 102(e) Date: Nov. 20, 1990

[87] PCT Pub. No.: WO92/08938

PCT Pub. Date: May 29, 1992

[30] Foreign Application Priority Data

Nov. 20, 1990 [SE] Sweden ..... 9003687

[51] Int. Cl.[5] ..... F26B 3/00

[52] U.S. Cl. ..... 34/32; 34/34; 34/77

[58] Field of Search ..... 34/26, 27, 29, 32, 34, 34/73, 75, 76, 78, 79, 82, 17

[56] References Cited

U.S. PATENT DOCUMENTS 3,866,333 2/1975 Sarukahanian et al. .
4,043,049 8/1977 Hedstrom .
4,495,710 1/1985 Ottoson .

FOREIGN PATENT DOCUMENTS 3237791 5/1983 Fed. Rep. of Germany .

*Primary Examiner*—Henry A. Bennet
*Attorney, Agent, or Firm*—Burns, Doane, Swecker & Mathis

[57] ABSTRACT

In a method for drying a particulate material, the material is supplied into a first drying conduit where it is dried and transported to a first cyclone by means of drying air. The material is separated from the drying air in the first cyclone. The separated material is supplied into a second drying conduit where it is dried and transported to a second cyclone by means of drying air. The material is separated from the drying air in the second cyclone. The drying air is discharged from the respective cyclone. The major part of the drying air discharged from the first cyclone is conveyed to a condenser so as to be subsequently supplied into a first drying conduit, while the remainder thereof is discharged. An amount of the drying air discharged from the second cyclone, which corresponds to this remainder, is conveyed to the condenser to be supplied into the first drying conduit. The remainder of the drying air discharged from the second cyclone is supplied into the second drying conduit. An amount of fresh air, which corresponds to the remainder of the drying air discharged from the first cyclone, is supplied into the second drying conduit.

16 Claims, 1 Drawing Sheet

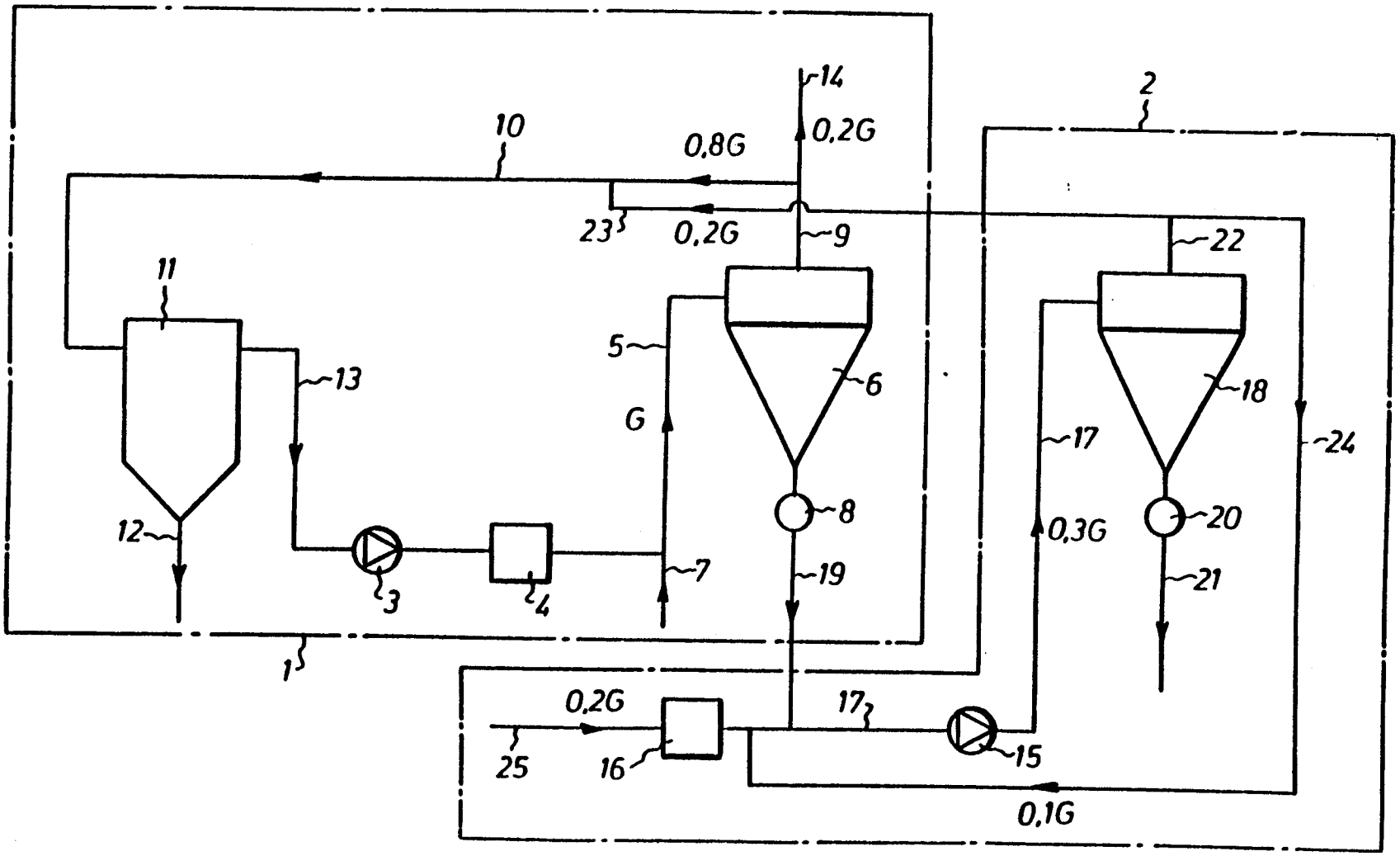
2
24
22
18
20
21
17
0,3G
0,1G
15
14
0,2G
9
6
8
19
17
0,8G
0,2G
7
5
G
23
16
0,2G
25
10
4
3
13
1
11
12

METHOD FOR DRYING A PARTICULATE MATERIAL

The present invention relates to a method for drying a particulate material, such as wood fibres for making fibreboards, in which method the material is transported through a two-stage drying plant by means of drying gas, e.g. drying air, the material being supplied, in a first stage, into a first drying conduit where it is dried in a first drying gas flow transporting the material to a first cyclone in which it is separated from the drying gas which is discharged from the first cyclone, and the material separated in the first cyclone being supplied, in a second stage, into a second drying conduit where it is dried in a second drying gas flow transporting the material to a second cyclone in which it is separated from the drying gas which is discharged from the second cyclone.

In a prior art method of effecting a two-stage drying of this type, fresh air is blown in as drying air in the first stage, whereupon this air is separated in the first cyclone and emitted from the first stage. The used drying gas is emitted into the atmosphere but is previously used to preheat the fresh air which is blown in in the first stage. In this connection, the used drying air is passed through a heat exchanger. The heat exchanger is combined with a scrubber for washing the used drying air. In this prior art method, fresh air is blown in as drying air also in the second stage, whereupon this air is separated in the second cyclone and emitted into the atmosphere.

When this prior art method is used to dry glue-coated wood fibres for making fibreboards, the used drying air emitted into the atmosphere contains, despite the washing described above, fibre dust, formaldehyde and hydrocarbons.

The object of the present invention is to provide a method for drying a particulate material, such as wood fibres, in which method the emission of pollutants into the atmosphere is reduced, simultaneously as the drying gas is utilised in an effective manner.

According to the present invention, this object is achieved by a method which is of the type mentioned by way of introduction and characterised in that the major part of the drying gas discharged from the first cyclone is conveyed to a condenser so as to be subsequently recirculated in the first stage, that the remainder of the drying gas discharged from the first cyclone is emitted from the plant, that an amount of the drying gas discharged from the second cyclone, which corresponds to said remainder of the drying gas discharged from the first cyclone, is conveyed to the condenser to be circulated in the first stage, that the remainder of the drying gas discharged from the second cyclone is recirculated in the second stage, and that an amount of fresh drying gas, e.g. fresh air, which corresponds to said remainder of the drying gas discharged from the first cyclone, is supplied to the second stage.

About 80% of the drying air discharged from the first cyclone is preferably conveyed to the condenser.

The second drying gas flow preferably is about 30% of the first drying gas flow.

The first drying flow preferably has a temperature of 150° C.–180° C., while the second drying gas flow preferably has a temperature of 110° C.–135° C.

BRIEF DESCRIPTION OF DRAWING

The invention will now be described in detail with reference to the accompanying drawing which schematically illustrates a plant for carrying out the method according to the present invention.

The plant shown in the drawing and intended for drying wood fibres for making fibreboards, has two drying stages, viz. a first stage 1 and a second stage 2.

In the first stage, use is made of a first fan 3 which blows drying air, which is heated to a temperature of about 160° C. in a first heating device 4, through a first drying conduit 5 opening into a first cyclone 6. Glue-coated wood fibres which are to be dried are supplied through a first supply conduit 7 into the first drying conduit 5 and are transported by the drying air to the first cyclone 6. The wood fibres are dried while being transported. They are separated from the drying air in the first cyclone 6 and discharged therefrom by means of a first sluice arrangement 8.

The drying air is discharged from the first cyclone 6 through a conduit 9. The major part, preferably about 80%, of the drying air discharged from the first cyclone is passed through a conduit 10 to a condenser 11 in which vapour in the drying air is condensed to be discharged in the form of water containing fibre dust, formaldehyde and hydrocarbons from the condenser 11 to, for example, a water-purifying apparatus (not shown) through a duct 12. The drying air is passed from the condenser 11 through a conduit 13 to the first fan 3 to be recirculated in the first stage 1. The remainder of the drying air discharged from the first cyclone 6 is emitted from the plant through a conduit 14 and can be used as e.g. combustion air in a boiler plant.

In the second stage 2, use is made of a second fan 15 which blows drying air heated in a second heating device 16 through a second drying conduit 17 opening into a second cyclone 18. The wood fibres discharged from the sluice arrangement 8 of the first cyclone 6 are supplied through a second supply conduit 19 into the second drying conduit 17 and are transported by the drying air therein to the second cyclone 18. While being transported, the wood fibres are additionally dried. The dried wood fibres are separated from the drying air in the second cyclone 18 and are discharged therefrom by means of a second sluice arrangement 20. The dried fibres are passed through a conduit 21 on to a storage container (not shown).

The drying air is discharged from the second cyclone 18 through a conduit 22. An amount of the drying air discharged from the second cyclone 18, which corresponds to the drying air discharged from the first stage 1 through the conduit 14, is conveyed through a conduit 23 to the conduit 10 so as to be passed, together with the major part of the drying air discharged from the first cyclone 6, to the condenser 11 in order to be circulated in the first stage 1. The remainder of the drying air discharged from the second cyclone 18 is recirculated through a conduit 24 connected to the drying conduit 17, so as to be recirculated in the second stage 2. An amount of fresh air, which corresponds to the drying air discharged from the first stage 1 through the conduit 14 is supplied to the second stage 2 through a conduit 25 connected to the second heating device 16 in order to replace the drying air transferred from the second stage 2 to the first stage 1 through the conduit 23.

The flow of drying air in the second stage 2 (by which is meant the flow of drying air in the second drying conduit 17) preferably constitutes about 30% (0.3 G) of the drying air flow G in the first stage (by which is meant the flow of drying air in the first drying conduit 5). As mentioned above, preferably about 80% of the drying air in the conduit 5, i.e. about 0.8 G, is passed through the conduit 10 to the condenser 11. The flow of drying air discharged from the plant through the conduit 14 thus constitutes about 20% of the drying air flow in the conduit 5, i.e. about 0.2 G. The drying air flow in the conduit 23 thus also constitutes about 0.2 G, which means that the drying air flow recirculated through the conduit 24 in stage 2 is about 0.1 G, and that the flow of fresh air in the conduit 25 is about 0.2 G.

The fresh air is heated in the second heating device 16 to a temperature of about 150° C. The fresh air is mixed with the drying air recirculated through the conduit 24 and having a temperature of about 60° C., whereby a flow of drying air having a temperature of about 120° C. is obtained in the drying conduit 17.

I claim:

1. Method for drying a particulate material in which method the material is transported through a two-stage drying plant by means of drying gas, the material being supplied, in a first stage (1), into a first drying conduit (5) where it is dried in a first drying gas flow transporting the material to a first cyclone (6) in which it is separated from the drying gas which is discharged from the first cyclone, and the material separated in the first cyclone (6) being supplied, in a second stage (2), into a second drying conduit (17) where it is dried in a second drying gas flow transporting the material to a second cyclone (18) in which it is separated from the drying gas which is discharged from the second cyclone, characterised in that the major part of the drying gas discharged from the first cyclone (6) is conveyed to a condenser (11) so as to be subsequently recirculated in the first stage (1), that the remainder of the drying gas discharged from the first cyclone (6) is emitted from the plant, that an amount of the drying gas discharged from the second cyclone (18), which corresponds to said remainder of the drying gas discharged from the first cyclone (6), is conveyed to the condenser (11) to be circulated in the first stage (1), that the remainder of the drying gas discharged from the second cyclone (18) is recirculated in said second stage (2), and that an amount of fresh drying gas, which corresponds to said remainder of the drying gas discharged from the first cyclone (6), is supplied to the second stage (2).

2. Method as claimed in claim 1, characterised in that about 80% of the drying gas discharged from the first cyclone (6) is conveyed to said condenser (11).

3. Method as claimed in claim 1, characterised in that said second drying gas flow is about 30% of the first drying gas flow.

4. Method as claimed in claim 1, characterised in that the first drying gas flow has a temperature of 150° C.–180° C.

5. Method as claimed in claim 1, characterised in that the second drying gas flow has a temperature of 110° C.–135° C.

6. Method as claimed in claim 2, characterized in that said second drying gas flow is about 30% of the first drying gas flow.

7. Method as claimed in claim 2, characterized in that the first drying gas flow has a temperature of 150° C.–180° C.

8. Method as claimed in claim 3, characterized in that the first drying gas flow has a temperature of 150° C.–180° C.

9. Method as claimed in claim 6, characterized in that the first drying gas flow has a temperature of 150° C.–180° C.

10. Method as claimed in claim 2, characterized in that the second drying gas flow has a temperature of 110° C.–135° C.

11. Method as claimed in claim 3, characterized in that the second drying gas flow has a temperature of 110° C.–135° C.

12. Method as claimed in claim 4, characterized in that the second drying gas flow has a temperature of 110° C.–135° C.

13. Method as claimed in claim 6, characterized in that the second drying gas flow has a temperature of 110° C.–135° C.

14. Method as claimed in claim 7, characterized in that the second drying gas flow has a temperature of 110° C.–135° C.

15. Method as claimed in claim 8, characterized in that the second drying gas flow has a temperature of 110° C.–135° C.

16. Method as claimed in claim 9, characterized in that the second drying gas flow has a temperature of 110° C.–135° C.

* * * * *

UNITED STATES PATENT AND TRADEMARK OFFICE

CERTIFICATE OF CORRECTION

PATENT NO. : 5,295,310

DATED : March 22, 1994

INVENTOR(S) : Lennart Eriksson

It is certified that error appears in the above-indentified patent and that said Letters Patent is hereby corrected as shown below:

On the title page, item [86], change "Nov. 20, 1990" (both occurrences) to --May 13, 1993--.

Signed and Sealed this

Twenty-first Day of June, 1994

*Attest:*

Bruce Lehman

BRUCE LEHMAN

*Attesting Officer*

*Commissioner of Patents and Trademarks*